United States Patent [19]

Fort

[11] 4,291,630

[45] Sep. 29, 1981

[54] MACHINE FOR EXTRACTING CENTRIFUGED PIPE

[75] Inventor: Pierre H. Fort, Nancy, France

[73] Assignee: Pont-a-Mousson S.A., Nancy, France

[21] Appl. No.: 50,858

[22] Filed: Jun. 21, 1979

[30] Foreign Application Priority Data

Jun. 23, 1978 [FR] France ..... 78 18812

[51] Int. Cl.[3] ..... B61K 5/00; B61B 9/00; B61B 12/10

[52] U.S. Cl. ..... 104/173 R; 164/404; 164/295; 104/77; 74/89.22

[58] Field of Search ..... 164/404, 295; 104/147 R, 202, 217, 173 R, 178, 177; 212/76; 74/89.22

[56] References Cited

U.S. PATENT DOCUMENTS

| | | | |
|---|---|---|---|
| 967,039 | 8/1910 | McNane | 164/404 |
| 1,796,703 | 3/1931 | Carrington | 164/295 |
| 1,960,366 | 5/1934 | Barr et al. | 164/404 |
| 2,853,755 | 9/1958 | Beyer | 164/295 |
| 2,870,496 | 1/1959 | Cooper | 164/295 |
| 3,397,735 | 8/1968 | Taccone | 164/404 |
| 3,466,937 | 9/1969 | Motis | 74/89.22 |
| 3,485,479 | 12/1969 | Baker | 74/89.22 |

*Primary Examiner*—Richard A. Bertsch

*Attorney, Agent, or Firm*—Sughrue, Rothwell, Mion, Zinn and Macpeak

[57] ABSTRACT

An extractor carriage is furnished on each side with an elbow bracket projecting towards its lower portion. To each of these brackets is attached the end of a cable which moves the carriage in its forward direction towards the centrifuging machine. Each cable is protected at its upper portion from sand debris by lateral wings extending from the upper portions of a trough which receives the debris. These cables, as well as a third cable for returning the carriage, are wound around a single motor drum driven by hydraulic motors which are capable of operating at several speeds. The invention may be applied to centrifuging equipment for cast iron pipe.

11 Claims, 4 Drawing Figures

MACHINE FOR EXTRACTING CENTRIFUGED PIPE

BACKGROUND OF THE INVENTION

The present invention is related to a machine for extracting centrifuged pipe of the type including a track which is oriented substantially horizontally and which is furnished with a trough for receiving sand debris and supporting the extraction carriage, a flexible traction element for the carriage operating in two directions and including an upper part for moving the carriage in the reverse direction attached to the rear of the carriage and part for moving the carriage in the forward direction attached to a lower projection from the carriage, and means for simultaneously driving the two parts at the same speed in the two directions.

In the known machines of this general type, the transmission element is constructed of a single chain which, to depart from the rear of the carriage, extends toward the rear, runs towards the base on a motor chain wheel, extends towards the front portion to a fixed chain wheel and finally returns to the rear at the projection. This chain is entirely continuous in the vertical plane of symmetry of the machine and, necessarily, a part of the chain extends above the trough and is directly exposed to the sand debris which results in the breaking of the chain or its joining members frequently during the extraction operation. The debris rapidly wears out the chain and the chain wheels and also hinders lubrication of the chain.

An object of the invention is to provide an extracting machine which does not have this problem and which, consequently, can function for long periods of time without replacement of the carriage driving mechanism.

To achieve this, the invention has as an object a machine of the above described type characterized in that the trough includes lateral edges and in that the lower part includes two halves which are each attached to a lateral elbow bracket projecting under the carriage and which extend under the edges. Thus, the lower part of the traction element is protected from sand debris.

This protection is further enhanced in that the supporting structure for the track has at each side a basin or cavity in which the two halves are positioned and of which the lateral wall extends upward to the vicinity of the corresponding bracket.

The falling sand may further be completely isolated from one part of the traction element if the upper part is situated in the assembly in the plane of symmetry of the carriage, is separated from the lower part and is rolled around a motor drum situated beyond the end of the rear part of the track. In this case, the mechanical assembly of the invention can have a particularly simple and reliable structure if each half of the lower part includes two portions, one of which is wrapped around an end of the motor drum.

The inventive concept is particularly well adapted for using cables for the flexible elements which thereby makes the machine much quieter than prior art constructions.

Still further, it is quite advantageous that, in a machine of the type mentioned above, the driving means includes a two-speed motor, for example, a constant power hydraulic motor with variable cylinders controlled by a distributor. In effect, the motor power available is then perfectly well adapted to the requirements of extracting the centrifuged pipe which requires the provision of a main force and a slow displacement of the carriage to detach the pipe from the shell, after which a much more weak force but a much more rapid displacement is necessary to increase the rate of production and to derive the maximum benefit from the heat energy stored in the casting furnace, as well as to reduce the subjection of the shell to excessive thermal constraints, thereby risking its deformation.

Other characteristics and advantages of the invention may be seen with reference to the description which follows, which is not limited to the examples given, and with regard to the attached drawings, in which.

DESCRIPTION OF THE PREFERRED EMBODIMENTS

Figure 1:
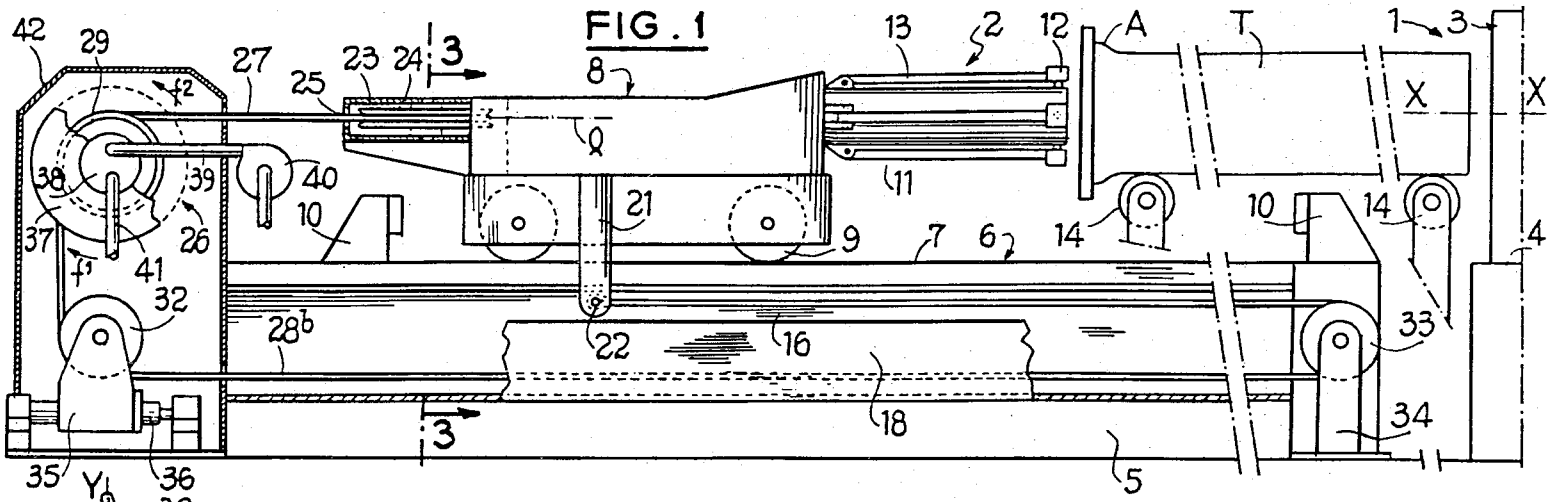
FIG. 1 is a schematic elevation view with cutaway portions of a centrifuging apparatus including a machine for extracting centrifuged pipe in accordance with the invention.
Figure 2:
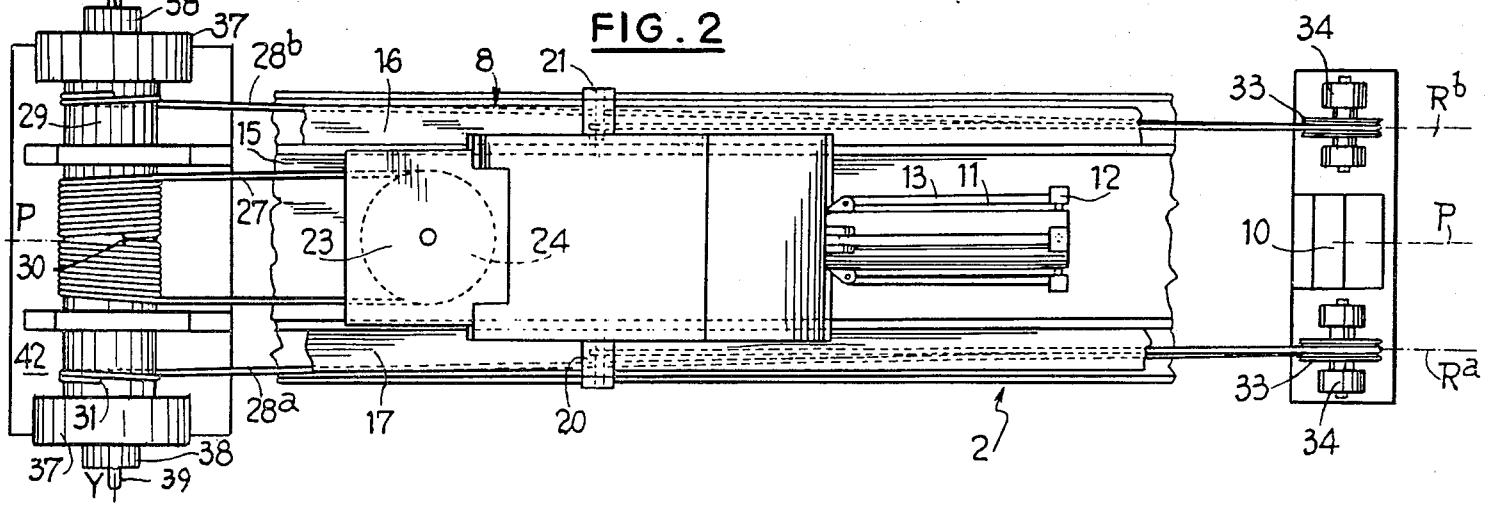
FIG. 2 is a plan view with portions cut away of the extracting machine of FIG. 1.
Figure 4:
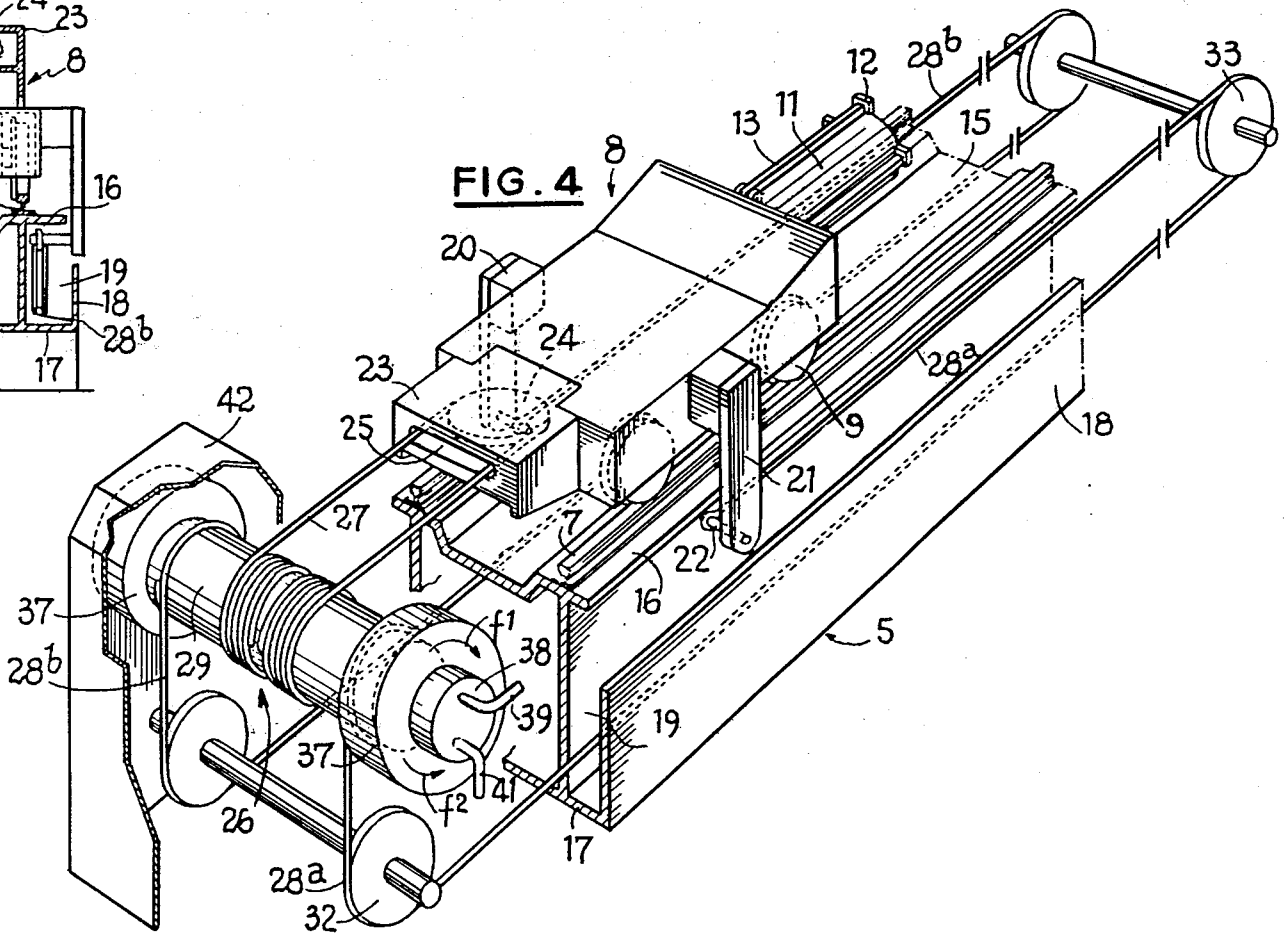
FIG. 4 is a schematic perspective view with portions cut away of the apparatus of FIGS. 1, 2, 3.

The centrifuging apparatus of FIG. 1 includes a centrifuging machine 1 and an extraction machine 2. Machine 1 includes a centrifuge carriage 3 of which only one end has been shown schematically in an outside view.

Carriage 3 contains a rotary centrifuging shell rotatable around axis X—X as well as rotational driving means and means for cooling the shell. It is displaced on a rolling track 4 which, at its end adjacent the extracting machine, is horizontal or is substantially horizontal. Upon withdrawal of machine 2, track 4 rises towards a pocket and a casting channel, not shown.

In the extension of centrifuging carriage 3, there is an elongated frame 5 supporting a rolling track 6 having two parallel rails 7 on which an extractor carriage 8 rides on wheels 9 between two abutments 10. Carriage 7 is furnished with a beam 11 along axis X—X extending outwards towards centrifuging machine 1 and having a predetermined number of extraction jaws mounted upon articulated levers 13 which are capable of being extended or withdrawn radially by mechanically or hydraulic means, not shown.

The apparatus is symmetrical with respect to a vertical plane D. There is also represented schematically in FIG. 1 a cast iron encasement pipe T which is extracted from machine 1 and supported between carriages 3 and 8 by several retractable supports 14 before being removed from the apparatus and moved to an outside position for further treatment.

The details of extracting machine 2 will now be described with the supposition that axis X—X of the shell at the end of the casing is horizontal as are rails 7.

Figure 3:
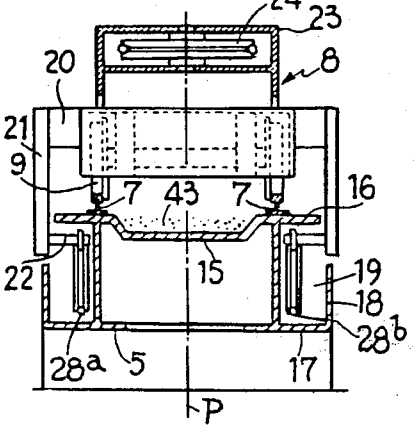
FIG. 3 is a transverse cross-sectional view taken along line 3—3 of FIG. 1.

Structure 5 includes along its total length at its upper part a trough 15 for collecting sand debris from the sand casting core broken during the extraction operation. Trough 15 has a flat bottom portion and has on each side a flat horizontal edge 16 upon which is attached a rail 7 as is shown best in FIG. 3. Structure 5 also has on each side at its lower part a flat horizontal edge 17 which terminates slightly further away from the plane of symmetry than the corresponding edge 16 and which is extended by a vertical wall 18. A free space exists between walls 18 and edges 16 of the trough so that frame 5 forms two lateral open casing portions 19 having rectangular cross sections.

Carriage 8 is provided on each side to which is attached a vertical bracket 21 positioned directly above a wall 18 and which extends towards the base with a small distance between the upper edge of wall 18 and the lower edge of bracket 21. At its end, bracket 21 has a projection 21 directed toward plane D and thereby extending into casing portion 19 under a corresponding edge 16.

Carriage 8 also includes at its rear part an enclosure or support 23 for a pulley 24 which turns on a vertical axis and which is oriented in a general plane Q which contains axis X—X. Enclosure 23 communicates with the outside by a horizontal slot 25 furnished in its rear wall in plane Q.

Driving of carriage 8 along the length of track 8 is provided by a single winch 26 and three cables, namely an upper cable 27 and two lower cables **28*a* and 28*b***.

Drum 19 of winch 26 is cylindrical and has a horizontal axis Y—Y perpendicular to axis X—X with its uppr generatrix contained in plane Q of pulley 24. Cable 27 which performs the return operation for carriage 8, forms a loop which covers half of the circumference of pulley 24; its two ends being attached side-by-side upon the same generatrix of drum 29 in plane P.

Each cable **28*a*, 28*b* which provide the forward movement which carriage 8, have one end 31 attached at one end of drum 29. From there, they extend toward the base to a first return pulley 32, then extend horizontally to the front of the lower part of encasement 19 to a second return pulley 33 situated at the right of forward buffer stop 10 before returning horizontally to the rear at the upper part of encasement 19 up to the point where it is attached to projection 22 of carriage 8. Each cable 28*a*, 28*b*** continues in a vertical plane $R^a$, $R^b$ parallel to plane P.

Pulleys 33 are mounted upon fixed supporting members 34 whereas supporting members 35 of pulleys 32 are adjustably positioned parallel to axis X—X by tighteners on threaded shaft 36. The tautness of cables **28*a* and 28*b* may thus be adjusted. In another embodiment, the adjustment may otherwise be provided by tighteners integral with each bracket 21 of carriage 8**.

The driving of winch 26 will now be described. At at least one end of drum 29, and, in this example, at each end, there is directly mounted in engagement therewith a motor or slow hydraulic receiver 37 having radial pistons and two speeds. Motor 37 may, for example, be a constant power motor sold in commerce by the company HELE-SHAW or by the company HÄGGLUNDS. Each motor 37 may work alternatively with all of its pistons thus providing a slow rotational driving speed but with a high torque or with only half of its pistons while then providing a speed double that of the preceding mode while providing a torque only half as big.

In order to effectuate the choice of speeds and torques, each motor 37 is coaxially equipped with a valve or distributor 38 having two active positions in each direction, the distributors of this type being items of commerce similar to motors 37. Each distributor 38 is capable of operating upon all of the pistons or on only half of the pistons of the associated motor 37 by conduits coupled and arranged in an appropriate manner, the liquid motor (oil or water) being operated under pressure by a common feeding conduit 39 coupled to the output of a common pump 40. A conduit 41 for returning the fluid discharged by each motor 37 to the common tank and its distributor valve 38 completes the driving system.

A valve 38 is provided for each motor 37 and one control for each valve 38 to thereby give the maximum functional flexibility to machine 2 and to permit the utilization thereof for numerous different types of centrifuged pipe. More precisely, during operation of pump 40, distributor valves 38 permit the choice of cylinders with which the motors work by connecting all of the pistons or only half the pistons of the motors to feeding conduit 39. For a constant supply of liquid furnished by pump 40 in conduit 39, may be chosen to be fed either all the pistons of the two motors 37, or all the pistons of a single motor, or all the pistons of one motor and half the pistons of the other, or half the pistons of each motor, or finally, half of the pistons of a single motor. For a constant supply, the larger the cylinder, the slower the speed and the smaller the cylinder, the higher the speed. But the larger the cylinder, the higher will be the motor torque. The operation of motors 37 is governed by the law of constant power which is the product of motor torque and the angular speed of rotation. The cylinders utilized in operation may thus be chosen from the force required to be furnished and the speed desired at each stage in the extraction operation.

A hood for protecting against powders, adjacent structure 5, surrounds winch 26 and has narrow openings therein for the passage of cables 27, **28*a* and 28*b***.

OPERATION

At the beginning, it is assumed that extraction carriage 8 is in the fully withdrawn position, for example, in abutment with buffer stop 10. Centrifuging carriage 3 is then positioned at the end of its path of travel 4 adjacent track 4 and at that time it contains in its rotary shell a pipe T, which is still hot and which is to be extracted.

(a) Forward movement of the extraction carriage:

Pump 40 is put in operation, distributor valves 38 are activated in such a fashion as to turn hydraulic motors 37 in the forward direction, that is, to drive extractor carriage 8 towards centrifuge carriage 3. By way of valve 38, a portion of the radial pistons of motors 37 are set not to operate, for example, only half the pistons of each motor or even half the pistons of a single motor, the others remaining inoperative. As a result, the necessary driving torque is low and the requisite speed is raised so as to accelerate the rate of production.

In the course of rotation of the drum of winch 29 in the direction indicated by arrow $f^1$, cables **28*a* and 28*b* produce a tractive force on brackets 21 and 22 of carriage 8 while being wound on drum 29. Simultaneously, the other cable 27 plays out at the same speed from the drum. The rotation of drum 29 continues, for example, until extractor carriage 8 strikes forward buffer stop 10 thereby activating a control contact which stops distributor valves 38 and motors 37. Alternatively, there may be provided for this function a proximity detector which picks up information transmitted by extractor carriage 8 or another appropriate device such as a pulse counter. Beam 11 and jaws 12 are then positioned within the interior of pipe T and jaws 12** are expanded to grip the inside of pipe T.

(b) First extraction time:

distributor valves 38 are activated in such a manner as to place in operation all of the available pistons of the two motors 37 and to cause drum 29 to turn in the reverse direction of carriage 8 indicated by arrow $f^2$. As a result, a high force is produced for detaching pipe T from the shell and which begin its displacement in the direction of separation and disengagement from the shell. Motors 37 then produce their maximum torque and drum 39 turns very slowly in the direction of arrow $f^2$. Cable 27 then exerts on carriage 8 a high tractive force which is divided into two equal forces on the two cables by pulley 24 which does not turn. Pipe T is thereby detached and its collar A leaves the shell of the centrifuge. From this time, it is not necessary that carriage 8 furnish a large tractive force on Pipe T. To the contrary, it is desirable that the remainder of the extraction be carried out as rapidly as possible. During this first phase of the extraction operation, carriage 8 is displaced a small distance only, for example, less than one meter.

(c) Second extraction time:

Distributor valves 38 are activated in such a manner as to connect the fluid under pressure furnished by pump 40 to a limited number of radial pistons of motors 37, for example, half the total number of pistons of the two motors, as the force required for extraction is much less than the force for detachment in the preceeding phase. Drum 29 then turns in the direction of arrow $f^2$ at a relatively high speed, and in any case, much higher than the corresponding speed of detachment. The two strands of cable 27 are simultaneously rolled onto drum 29 while cables 28*a* and 28*b* are played out. Supports 14 are placed in the active horizontal position so as to receive the stock of pipe T upon its removal. Carriage 8 stops its reverse movement, that is its movement in the extraction direction, as controlled, for example, by a proximity detector or another appropriate means.

It may be stated that during all movements of carriage 8, as the diameter upon which reverse cables 27 and forward cables 28*a* and 28*b* are wound is the same, the various cables remain always perfectly taut.

In another embodiment, the passage from the first time to the second time, that is, from the full cylinder condition to the half full condition, may be accomplished automatically if a pressure detector is placed in the feeding line of hydraulic motors 37 so that it may sense the drop in pressure of the motor. Effectively, as soon as pipe T is detached from the shell, the resistant force drops quickly so that the fluid pressure to the motor drops as well. It is then easy to make this detection of pressure act directly for controlling distributor valve 38 by means which need not be described in detail.

This automatic change method is particularly advantageous while the centrifuge shell is new and while the detachment process is easily performed and is of short duration because then a rapid extraction speed is reached very quickly during the extraction cycle thereby reducing the total duration of the cycle and, accordingly, accelerating the rate of production.

The extracting machine according to the present invention possesses the following advantages.

Because of the doubling up of the cables 28*a*–28*b* for the forward movement of the carriage, it is possible to protect it simultaneously from above by edges 16 of trough 15 and sideways by walls 18 of frame 5 while furnishing a protective housing which is very efficient in protecting them from undesirable scatterings, accidental detachments or falling of sand debris 43 (FIG. 3) coming from a casing core of the shell. The separate cable 27 for the reverse operation is always kept outside the area where sand debris may be present so that there is never any risk of it being adversely affected. Moreover, cables 27, 28*a* and 28*b* are protected from powders by hood 42 over winch 26. They always thus remain properly lubricated.

The cabling system to the drum of the single winch always remain in perfect equilibrium due to its symmetry about plane P. The two strands of cable 27 work under equal tension and thus prevent carriage 8 from being run off the track to either the right or the left. Carriage 8 does not have a tendency to rear up under the tractive force primarily because of the positioning of pulley 24 in the horizontal plane which contains the axis of extraction.

The operation of cables 27, 28*a*, and 28*b* is silent.

Rotary hydraulic motors 37 are directly coupled at their ends to drum 29 which simplifies the construction. No gearing is necessary. This instead is accomplished by distributor valves 38 which connect in or out of service a part or all of the radial pistons of motors 37. These working at a constant power, enable in combination with distributor valves 38 the attainment in each direction without a mechanical speed changing mechanism at least two speeds of rotation of the drum with a single motor and five speeds with two motors. These hydraulic motors provide with relatively little complexity a very high maximum torque which permits the utilization of the centrifuge shells for much longer periods of time than was heretobefore possible thereby prolonging their time in service even after they have become scored from usage which increases their resistance to detachment of the centrifuged pipe.

Because of the considerable increase in the maximum force of extraction it is possible to more quickly extract the pipe from the shell with extracting machines which employ the aforementioned technique. As a result, much less heat is lost than with prior art techniques thereby providing a not insubstantial savings in heat energy at the oven for further treatment and so that the shell is submitted for a shorter period of time to the severe thermal constraints while the pipe has not yet been detached.

The rapid removal of the pipe effectuated after its detachment also brings about a reduction in the heat losses from the pipe during the extraction operation so as to increase the rate of production and to minimize the exposure of the operator to heat radiated by the extracted pipe.

What is claimed is:

1. A machine for extracting centrifuged pipe comprising a rolling track oriented substantially horizontally and supporting an extracting carriage, a flexible element for traction of the carriage in two directions including an upper part for movement of the carriage in the reverse direction attached to the rear of the carriage and being positioned in a horizontal plane passing through the axis along which the carriage moves and a lower part for moving the carriage in the forward direction attached to a projection from the lower portion of the carriage, and means for simultaneously driving at the same speed the two parts of the flexible element in both directions, said upper part includes two strands which are symmetric about a vertical plane of symmetry through the carriage and which pass around a balanced wheel provided at the rear of the carriage.

2. A machine according to claim 1 wherein said upper part is positioned within the assembly in said vertical plane of symmetry of the carriage, is separate from said lower part and is rolled around a motor drum positioned beyond the rear end of the rolling track.

3. A machine in accordance with claim 2 wherein the driving means comprises a two-speed motor.

4. A machine in accordance with claim 2 wherein the rolling track is furnished with a trough for receiving sand debris, the track has lateral edges and in that said lower part of said flexible element includes two halves which are each attached to a lateral elbow bracket projecting from the carriage and which extend from under said edges.

5. A machine in accordance with claim 4 further comprising a frame for supporting said rolling track and having on each side an encasement member into which extends one of said halves and which further has lateral walls extending upwards to near the end of a corresponding bracket.

6. A machine in accordance with claim 4 wherein each of said halves of said lower part of said flexible element comprises two strands, at least one of said strands being wound around one end of said motor drum.

7. A machine in accordance with claim 2 further comprising a protective hood at least partially enclosing said motor drum.

8. A machine in accordance with claim 2 wherein said traction element comprises cables.

9. A machine for extracting centrifuged pipe comprising a rolling track which is oriented substantially horizontally, an extracting carriage, a flexible traction element for moving the carriage in forward and reverse directions, the traction element including an upper part for moving the carriage in the reverse direction attached to the rear of the carriage and an upper part for moving the carriage in the forward direction attached to a projection from the lower portion of the carriage, and means for simultaneously driving at the same speed the two parts of the flexible traction element in the two directions, said driving means comprising a two-speed motor.

10. A machine in accordance with claim 9 wherein said motor comprises a constant power hydraulic motor having plural cylinders, and distributor means coupled to said motor for controlling which of said cylinders is operable.

11. A machine in accordance with claim 10 wherein said distributor is automatically controlled by a hydraulic pressure detector.

* * * * *